United States Patent [19]

Vosbein et al.

[11] Patent Number: 4,623,099

[45] Date of Patent: Nov. 18, 1986

[54] OPENING DEVICE FOR OPENING PRESSED FIBER BALES

[75] Inventors: Gerd Vosbein, Senden; Hubert Hergeth, Dülmen, both of Fed. Rep. of Germany

[73] Assignee: 501 Hergeth Hollingsworth GmbH, Dülmen, Fed. Rep. of Germany

[21] Appl. No.: 652,154

[22] Filed: Sep. 18, 1984

[30] Foreign Application Priority Data

Sep. 21, 1983 [DE] Fed. Rep. of Germany ..... 3334069

[51] Int. Cl.[4] ..... B02C 19/12

[52] U.S. Cl. ..... 241/101 A; 19/80 R; 241/101.7

[58] Field of Search ..... 19/80 R, 80 A; 241/101 A, 101.7, 277, 282.1

[56] References Cited

U.S. PATENT DOCUMENTS 4,281,437 8/1981 Marx ..... 241/101 A X

*Primary Examiner*—Mark Rosenbaum

*Attorney, Agent, or Firm*—Cort Flint

[57] ABSTRACT

The opening device for opening pressed fiber bales, e.g. cotton bales or the like comprises opening rollers containing opening disks or needles to coact with a grate. If the opening device and the fiber bales contact each other in movement, the teeth of the opening disks or the like engage the fiber bales. To this effect, the grate rods (22,39,43) comprise an offset portion (32,40,43) extending transversely to the direction of travel (5) of the opening device (1), at least one opening disk (28;29) being arranged ahead of and/or behind the offset portion. Thus, an equalizing effect is achieved for the removal of flocks from the fiber bales.

10 Claims, 5 Drawing Figures

OPENING DEVICE FOR OPENING PRESSED FIBER BALES

Figure 1:
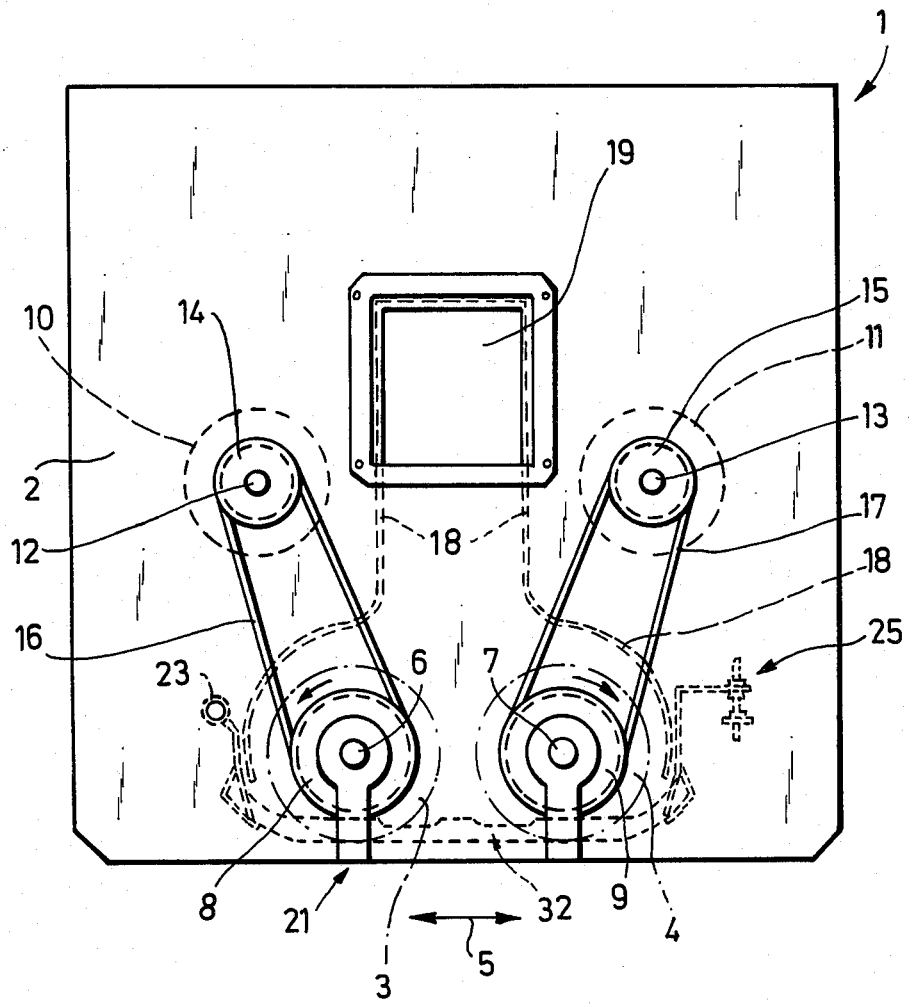

The invention relates to an opening device for opening pressed fiber bales, e.g. cotton or staple fiber bales etc. comprising opening rollers having opening plates which are coacting with a grate.

According to German Patent No. 28 47 520, there has been known an opening device in which a milling roller is provided to reciprocate above a row of fiber bales, the needles or teeth of the milling roller extending through a grate to pick fiber flocks from the bale surface. The respective grate comprises tiltable rods which may be mounted subject to the direction of travel of the opening device. In one travel direction of the milling roller, the grate takes a swivelled-out position, while the grate provided at the other side of the milling roller rests on the surface of the fiber bales. The respective effective grate is so mounted that its ends engage the gaps between the needles of the milling roller, the end of the grate rods extending to the range of engagement of the needles in the surface of the fiber bales. By the portion resting on the bales, the grate acts as a hold-down means.

German Patent No. 11 31 567 discloses a bale rasp for opening pressed fiber bales, in which the rotating tooth disks are urged between grate rods against a fiber bale passed along on them. The bale conducted along a rod grate being cleared but on a very restricted space locally, the tooth disks are of the tumbling type, i.e. they are provided at an angle different from 90° relative to the axis of rotation.

Due to the inclined position of the disks, the latter are tumbling between two extreme positions to contact nearly the total space between the grate rods. Such tumbling tooth disks call for a particular design and support. As for the removal, the material extending along the grate rods at the surface of the bales is not affected directly.

It is the object of the ihvention to provide an opening device of the foregoing kind in which the grate rods are situated between the opening disks, e.g. tooth disks, the opening device and the fiber bales passing by each other, whereby the teeth of the opening disks engage the fiber bales, the removing effect over the surface of the fiber bales being more uniform and substantially improved, and the stability of the grate being increased is well. With the described opening device, the invention is characterized in that the grate rods comprise an offset portion extending transversely to the direction of movement of the opening device, and at least one opening disk being fitted ahead of and/or behind the offset portion.

Due to the provided offset design of the grate rods, a stroking effect by the total grate is obtained at the surface of the fiber bale or the row of fiber bales with the consequence of an equalization caused by the grate rods and the grate in regard to the uneven portions resulting from the action of the opening disks or needles of a milling roll at the surface of the fiber bales during the reciprocating movement of the opening means. Due to the offsetting of the grate rods or their offset portion, it is possible, when the fiber bale surfaces are contacted that the material on the bale surface will be distributed transversely to the travel direction, thus pressing away or displacing laterally to the channels formed by the reduction, the elevations remaining in the diredtion of travel. The height of the bale surface will be equalized. At the same time, the quality of the reduction effect is improved in that with the opening of the fiber bales, fibers rather than batches are thrown away.

The material ribs more or less left otherwise beneath the grate rods are displaced laterally into the path of the opening disk or disks. Due to the offset portion of the grate rods, the material is retained more effectively in the direction of width of the bale, so that the fibers may be detached more intensely from the bale surface. The resultant surface will be milled more cleanly. At the same time, by the offsetting of the grate rods, their stability will be improved.

From the input side to the output side, the grate rods may be provided obliquely relative to the direction of travel of the opening device. The opening tooth disks are mounted in-between it being imperative to take care that the obliquely extending grate rods are so spaced that the tooth disks will not contact them.

According to another feature of the invention, the central region of the grate rods may be oblique. If so, the opening disks will be fitted such as to ensure that with two of them in successive order, each extends in the elongation of a grate rod portion situated outside the inclination or kink. By this means, each opening disk will process directly the rib-shaped elevation left by the preceding opening disk, whereby the offset portion of the grate rod additionally causes an equalization of the surface of the fiber bales.

The offset design of the grate rods may also influence the control of the flock size. The inclination may range within an angular field of 10° to 20°. It turned out that 15° would be the preferred angle position.

To avoid an extensive length of the grate rods between the clamping points, their height within the reach of the kink points should be inferior to that outside them. By this means, the opening disk may be approached as close as possible to the inclined grate rod.

Advantageously, the opening means comprises opening rollers containing two opening disks successively provided in the direction of travel. Each opening roller is driven by a motor. In the interspace between the grate rods including the offset portion, there are provided at least two consecutive opening disks.

Embodiments of the invention will be explained hereunder in more details with reference to the drawing.

Figure 2:
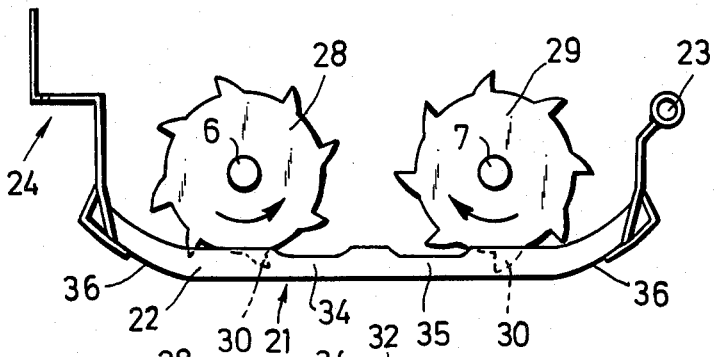
Figure 3:
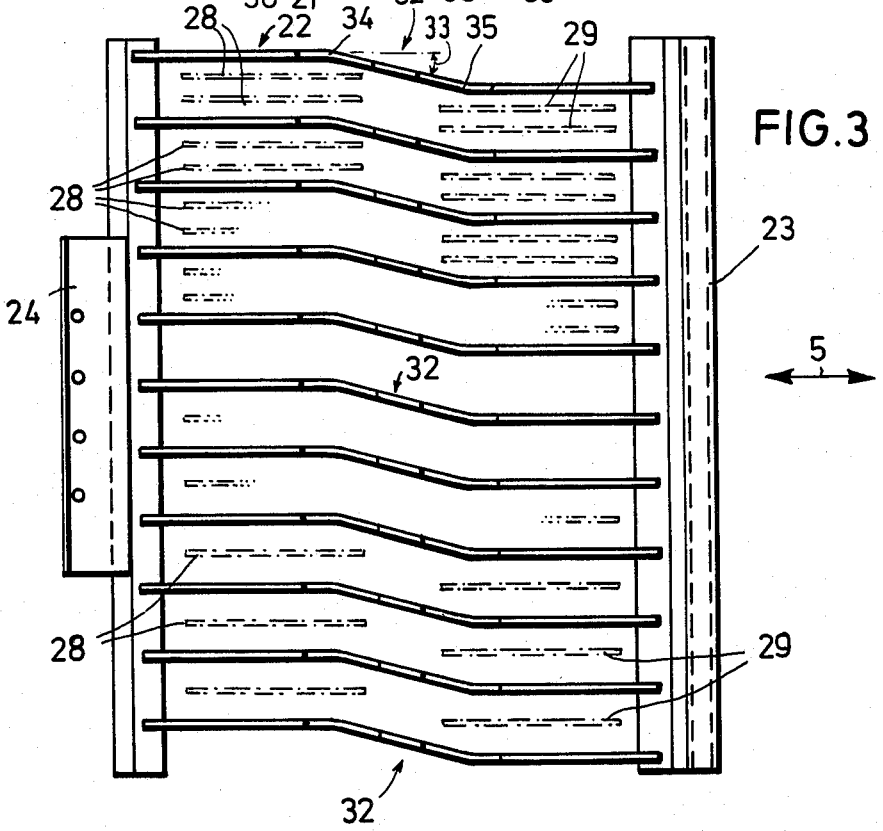
Figure 4:
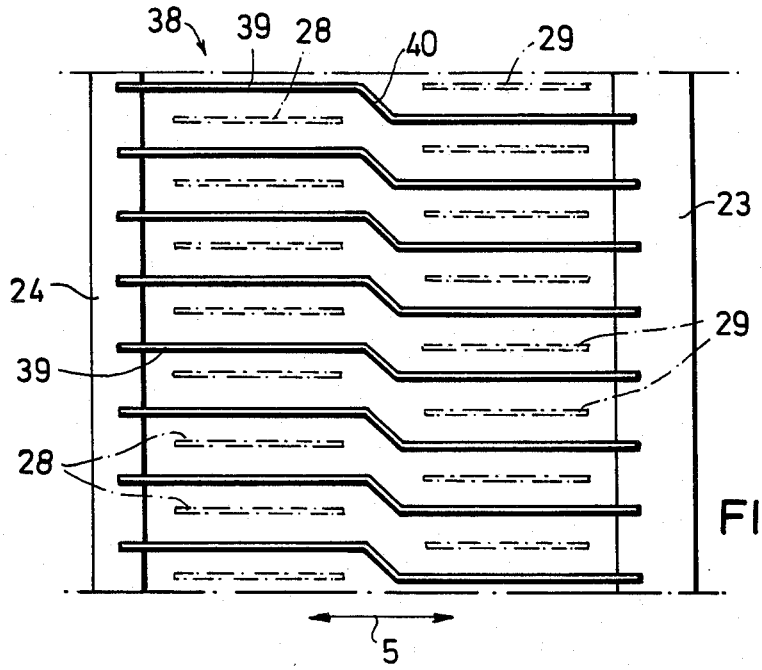
Figure 5:
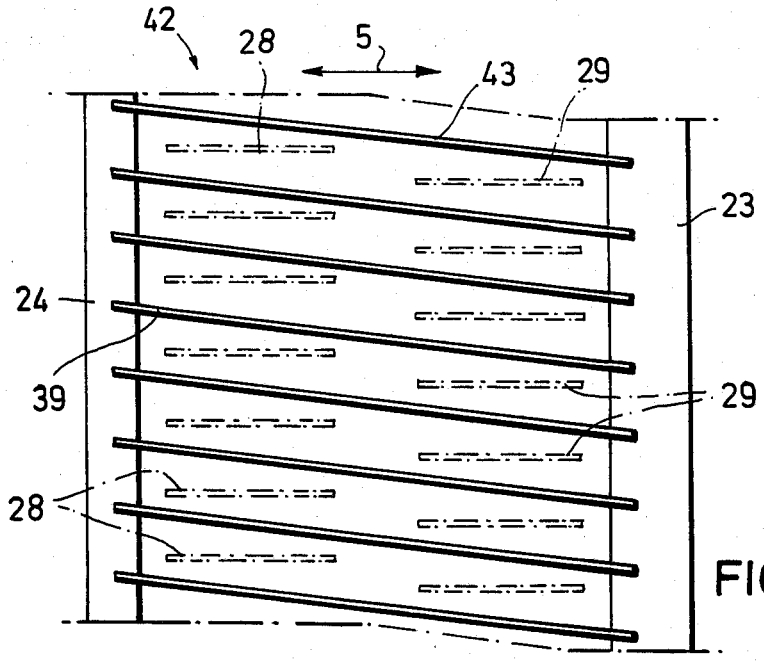

FIG. 1 shows a cross sectional and schematic view of an opening device of the invention in the form of a milling head housing having two opening rollers arranged consecutively in travel direction, FIG. 2 is a scaled-up detail of the milling head housing of FIG. 1, FIG. 3 is a schematic plan view of the grate, FIGS. 4 and 5 show a plan view and a schematic illustration of other embodiments of the grate.

The opening device 1 for opening pressed fiber bales etc. comprises a housing 2 in which two opening rollers 3 and 4 are consecutively mounted in travel direction according to arrow 5. The opening rollers 3 and 4 are supported by axles 6 and 7 on which driving plates, e.g. belt pulleys 8 and 9 are arranged. Both opening rollers 3 and 4 are provided with separate drives. To this effect, motors 10 and 11 may be fixed by flanges at the end walls of the housing 2. The driving shafts 12 and 13 of the motors comprise drive pulleys 14 and 15 from which the transmission is performed by means of belts 16 and 17 to the drive pulleys 8 and 9. As indicated by the arrows, the opening rollers 3 and 4 are rotating in opposite sense relative to each other. They are enclosed by an inner housing 18 extending to the outlet piece 19 of a suction draft.

The opening rollers 3 and 4 may be roller drums having needles affixed thereto. Preferably, the opening rollers comprise disks which are provided in a predetermined spaced relationship in axle direction of the rollers. The opening rollers are cooperating with a grate 21 composed of a series of grate rods 22 which are pivoted at 23, on the one hand, and fixed at a mounting 25 so as to be adjustable in height, on the other hand.

Concerning the direction of travel of the opening device, according to the arrow, the grate rods 22 are provided with an offset portion which may be of different designs.

In the embodiment of FIG. 3, an offset portion 32 is provided in the central longitudinal region of the grate rods 22, in other words, the central region of the latter is inclined. To control the flock size, the angular region may vary within the range of about 10° to 20°. In the illustrated example, an angle 33 of 15° is shown. Preferably, the opening disks 28 and 29 are toothed by containing at their periphey projecting teeth 30 of a predetermined number which engage the space between the grate rods 22. Between two grate rods 22 with the angular offset portion 32, the opening disks 28 and 29 engage the surface of the set-up fiber bales. Ahead of and behind the offset portion 32 of the grate rods 22, there are provided opening disks 28 and 29, it being possible to dispose the opening disks of the consecutively arranged opening rollers 3 and 4 in series and parallel to the direction of travel of the opening device. It is also possible to offset the opening disks relative to one another so that they are situated in the elongation of the grate rod elements which extend in parallel to the direction of movement. Further, more than one opening disk in juxtaposed position may be provided between two grate rods 22. As evident from the upper part of FIG. 3, two adjacent opening disks 28 and 29 are located in the space between two grate rods 22, while in the lower part of said FIG. 3, only one opening disk 28 or 29 of the opening rollers 3,4 is disposed in the space between two grate rods 22. Advantageously, the height 34 or 35 within the reach of the kink points of the grate rods 22 is inferior to the height outside thereof. Thus, it is possible to approach the opening disks more closely to the offset portion.

The lower edges 36 at the ends of the grate rods 22 are suitably inclined upwardly to allow a frictionless contact in movement between the bale surface and the grate rods.

In the embodiment of FIG. 4, a grate 38 is shown the grate rods 39 of which comprise a central region with a relatively steep portion 40 of about 40° to 50°. The grate rods 39 are situated in a rather close relationship, the opening disks 28 being provided in the elongation of the straight portion of the grate rods 39 between the opening disks 29 while the opening disks 2 are arranged in the elongation of the straight portion between the opening disks 28. By this means, the material ribs left under the respective straight portions are processed by the following opening disks.

In the embodiment of FIG. 5, the grate 42 is of such a design that the grate rods extend at a continuous inclination relative to the direction of movement 5 of the opening device. With such a grate design, one obtains a more uniform surface of the fiber bale to be reduced. Due to the displacement of the grate in travel direction according to arrow 5 either in one direction or the other, the material portions left on the surface of the fiber bales are displaced laterally. In this case, the opening disks 28 of the one opening roller are offset with respect to the opening disks 29 of the other opening roller in regard to the direction of travel.

What is claimed is:

1. In a fiber bale opening device for opening pressed fiber bales such as cotton and staple fiber bales having an opening device housing in which opening rollers having opening disks with teeth or needles are provided to cooperate with a grate whose grate rods are situated between the opening disks, said opening device housing and the fiber bales moving relatively by each other in contact with the teeth or needles of the opening disks engaging the fiber bales; wherein the improvement comprises:

said grate rods including a laterally inclined offset portion extending in transverse direction to the direction of movement of the opening device housing; and at least one opening disk being mounted ahead of such offset portion and at least one other opening disk being mounted behind each said offset portion in a manner that ridges of fiber created by said opening device are evened out by said opening disks upon movement of said opening device housing in opposite directions relative to said bales.

2. The opening device according to claim 1, wherein said grate rod contain said laterally offset portion in their central region.

3. The opening device according to claim 1 or 2, wherein said offset portion is inclined within an angular range of about 10 degrees to 20 degrees with respect to the direction of travel of said opening device housing.

4. The opening device of claim 3 wherein said offset portion is inclined about 15 degrees with respect to the direction of travel of said opening device housing.

5. The opening device according to claim 1, wherein said inclined offset portion is provided within an angular range of 30 degrees to 50 degrees with respect to the direction of travel of said opening defice housing.

6. The opening device according to claim 1, wherein said grate rods are inclined relative to the direction of movement of the opening device over their total length.

7. The opening device of claim 1 wherein each said grate rods includes a first straight section and a laterally offset portion followed by a second straight section in a manner that said first and second straight sections are displaced laterally with respect to each other, and a kink point defined by the intersection of said laterally off-set portions with said first and second straight sections.

8. The opening device of claim 7 wherein a height of said grate rod is lower in said laterally offset portion between said kink points than in said first and second sections.

9. The opening device of claim 1 including two opening rollers having opening disks arranged consecutively spaced in series to the direction of travel and arranged laterally offset in an axial direction transverse to said direction of travel.

10. The opening device according to claim 1 wherein said grate rods include ends having lowered edges which are provided with upwardly directed chamfers.

* * * * *